US009173494B2

(12) United States Patent
Fahlstedt

(10) Patent No.: US 9,173,494 B2
(45) Date of Patent: Nov. 3, 2015

(54) SEATING DEVICE

(75) Inventor: Andreas Fahlstedt, Hagersten (SE)

(73) Assignee: ANDREAS FAHLSTEDT DESIGN, Hagersten (SE)

( * ) Notice: Subject to any disclaimer, the term of this patent is extended or adjusted under 35 U.S.C. 154(b) by 397 days.

(21) Appl. No.: 13/580,521

(22) PCT Filed: Feb. 24, 2011

(86) PCT No.: PCT/SE2011/000036
§ 371 (c)(1),
(2), (4) Date: Aug. 22, 2012

(87) PCT Pub. No.: WO2011/108966
PCT Pub. Date: Sep. 9, 2011

(65) Prior Publication Data

US 2012/0313412 A1 Dec. 13, 2012

(30) Foreign Application Priority Data

Mar. 1, 2010 (SE) ..... 1000189

(51) Int. Cl.
*A47C 1/124* (2006.01)
*A47C 3/14* (2006.01)

(52) U.S. Cl.
CPC .. *A47C 3/14* (2013.01); *A47C 1/124* (2013.01)

(58) Field of Classification Search
CPC ..... A47C 1/124; A47C 3/14
USPC ..... 297/248
See application file for complete search history.

(56) References Cited

U.S. PATENT DOCUMENTS

| | | | | | |
|---|---|---|---|---|---|
| 2,990,876 | A | * | 7/1961 | Brook | 297/239 |
| 3,009,738 | A | * | 11/1961 | Piker | 297/248 |
| 3,123,399 | A | * | 3/1964 | Wilson | 297/239 |
| 3,159,425 | A | * | 12/1964 | Engstrom | 297/248 |
| 3,237,984 | A | | 3/1966 | Schneider et al. | |
| 3,402,963 | A | | 9/1968 | Fujioka et al. | |
| 3,600,036 | A | * | 8/1971 | Iskander | 297/239 |
| 3,614,158 | A | * | 10/1971 | Mohr | 297/248 |
| 3,758,155 | A | * | 9/1973 | Straits | 297/248 |
| 3,826,453 | A | * | 7/1974 | Hitchcock | 297/248 |
| 4,154,476 | A | | 5/1979 | Blodee | |

(Continued)

FOREIGN PATENT DOCUMENTS

| | | |
|---|---|---|
| DE | 20 2007 000 97 U1 | 5/2007 |
| DE | 20 2009 007 65 U1 | 9/2009 |
| GB | 2447508 A | 9/2008 |

OTHER PUBLICATIONS

International Search Report, dated Jun. 7, 2011, from corresponding PCT application.

*Primary Examiner* — David R Dunn
*Assistant Examiner* — Tania Abraham
(74) *Attorney, Agent, or Firm* — Young & Thompson

(57) ABSTRACT

A seating arrangement includes at least two seating units connected together, wherein each seating unit includes a tubular frame and a seat supported by the tubular frame. The seating unit forms part of the seating arrangement. The seating arrangement is characterized in that each tubular frame defines a loop (5) projecting beyond one side of the seat (12), that the seat (12) is provided on the opposite side with an opening (21) and a retaining element (24) associated with the opening (21) and that the loop (5) of one seating unit is designed to engage with the retaining element (24) of an adjacent seating unit.

7 Claims, 14 Drawing Sheets

(56) References Cited

U.S. PATENT DOCUMENTS

| | | | | | |
|---|---|---|---|---|---|
| 4,386,804 | A * | 6/1983 | Ware et al. | 297/248 |
| 4,400,031 | A | 8/1983 | DeDecker | |
| 4,892,352 | A * | 1/1990 | Haywood | 297/195.11 |
| 4,978,168 | A * | 12/1990 | Piretti | 297/248 |
| 4,995,668 | A * | 2/1991 | Zivari | 297/248 |
| 5,282,669 | A * | 2/1994 | Barile | 297/248 |
| 5,511,851 | A * | 4/1996 | Zivari | 297/249 |
| 6,012,773 | A * | 1/2000 | Best | 297/248 |
| 6,733,082 | B1 * | 5/2004 | Treon | 297/440.22 |
| 2007/0227415 | A1 * | 10/2007 | Meiners | 108/91 |

* cited by examiner

SEATING DEVICE

TECHNICAL FIELD OF THE INVENTION

This invention relates to a seating arrangement including at least two seating units detachably connected together, wherein each seating unit includes a seat and connecting means associated with one side of the seat for supporting the seat relative to a surface when the seating unit is connected to another seating unit of the same kind, each seating unit including a connecting means. The invention also relates separately to a seating unit.

PRIOR ART

U.S. Pat. No. 4,154,476 discloses a folding seating system in which a tubular frame defines a number of parallel horizontal portions when it is in the extended position. These portions support foldable chair seats, wherein adjacent chair seats are connected together in the horizontal position in that a hook on one seat is received in a groove in an adjacent seat. The seats can also assume a vertical position when the tubular frame is in the folded position.

According to one embodiment, GB 2 447 508 discloses seating units with legs/supporting means on only one side. Mating engagement means on adjacent seating units can be brought into releasable engagement with one another. No further details are given about the design of these engagement means.

DE 20 2009 007 655 U1 discloses tubular connecting means for conventional chairs in which the tubular connecting means are "interlaced".

DE 20 2007 000 971 U1 discloses connecting means for conventional chairs in which a downwardly directed hook formed by a bent tube on one chair is received in a space in an adjacent chair, this space being defined by a bent tube.

Aims and Features of the Invention

A first aim of this invention is to provide a seating arrangement of the type specified in the introductory part, in which the mating engagement means are designed in such a manner that adjacent seating units are connected together in a manner that complies with the necessary safety measures.

Another aim of this invention is to allow for user-friendly connection and disconnection of adjacent seating units.

At least the first aim of this invention is achieved by means of a seating arrangement and a seating unit having the features specified in the following independent claims. Preferred embodiments of the invention are defined in the dependent claims.

BRIEF DESCRIPTION OF THE DRAWINGS

Preferred embodiments of the invention will now be described with reference to the accompanying drawings, in which.

DETAILED DESCRIPTION OF PREFERRED EMBODIMENTS OF THE INVENTION

Figure 1:
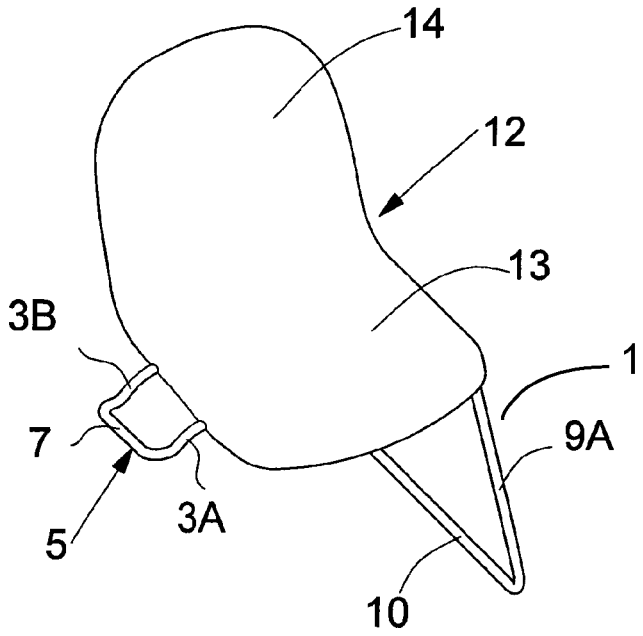
FIG. 1 is a perspective view of a first embodiment of a seating unit according to this invention, in which the seating unit is designed to form part of a seating arrangement according to this invention.
Figure 3:
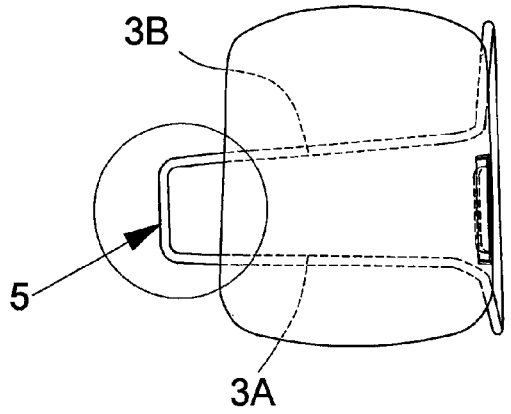
FIG. 3 is a plan view of the seating unit according to FIG. 1.
Figure 4:
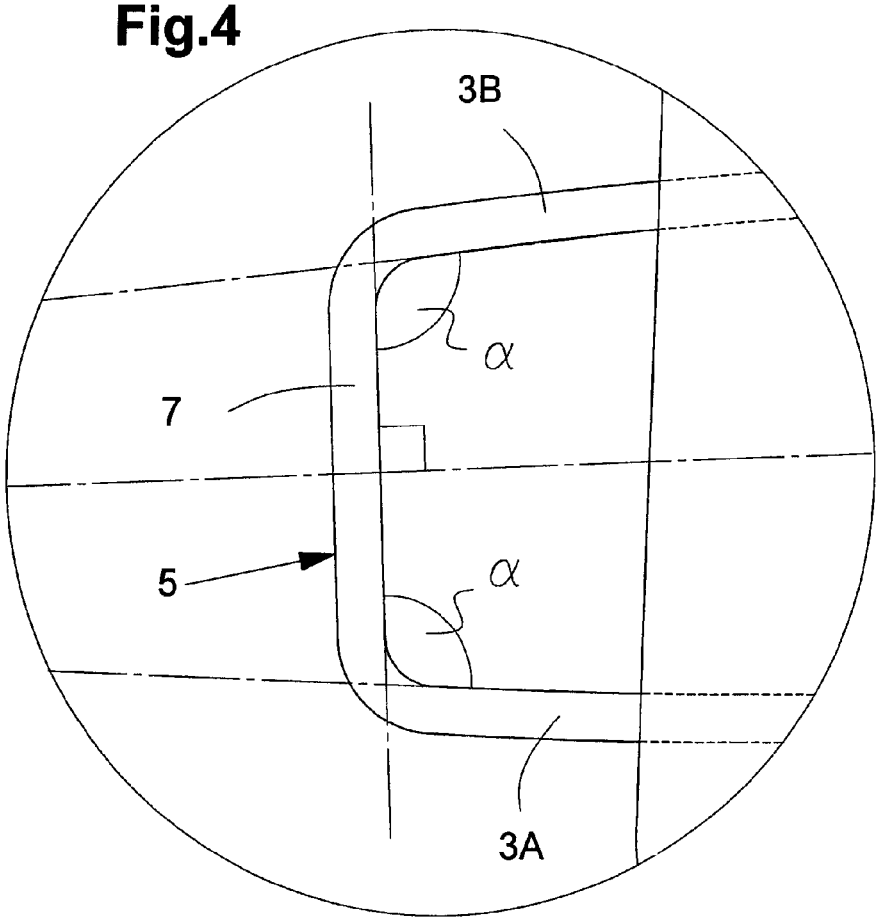
FIG. 4 is an enlarged view of the portion circled in FIG. 3.

The seating unit shown in FIG. 1 includes a tubular frame 1 formed by an endless bent tube in the embodiment shown. The tubular frame 1 in turn includes two first and second tubular portions 3A and 3B which are generally horizontal in the working position of the seating unit and which are connected together in the region of one of their ends by means of a loop/a third tubular portion 5 having a rectilinear intermediate portion 7 according to the embodiment shown. In the plan view (see FIGS. 3 and 4), the first and second tubular portions 3A, 3B converge towards one another in the direction towards the loop 5. In the plan view (see FIG. 4), the first and second tubular portions 3A and 3B form an angle $\alpha$ with the intermediate portion 7. The following should apply with respect to the angle $\alpha$: $90° < \alpha \leq 94°$.

Figure 2:
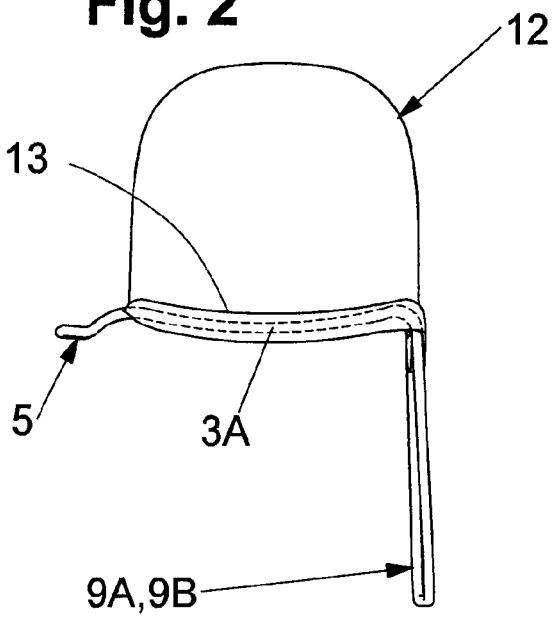
FIG. 2 is a front view of the seating unit according to FIG. 1.

According to the embodiment shown, the first and second tubular portions 3A and 3B are bent/curved downwards slightly when the seating unit is viewed from the front (see FIG. 2). This design will be discussed hereinbelow. It will also be clear from FIG. 2 that the loop 5 is inclined upwards slightly relative to an imaginary horizontal plane towards its free end.

Figure 5:
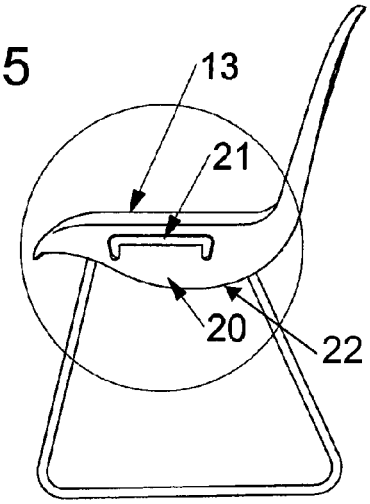
FIG. 5 is another side view of the seating unit according to this invention.
Figure 9:
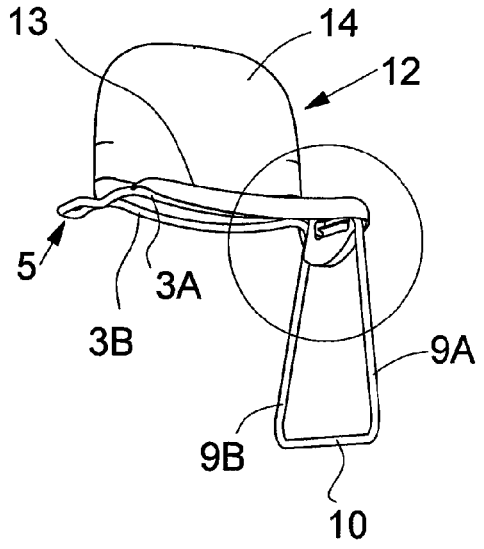
FIG. 9 is a perspective view of the seating unit according to FIG. 1.
Figure 10:
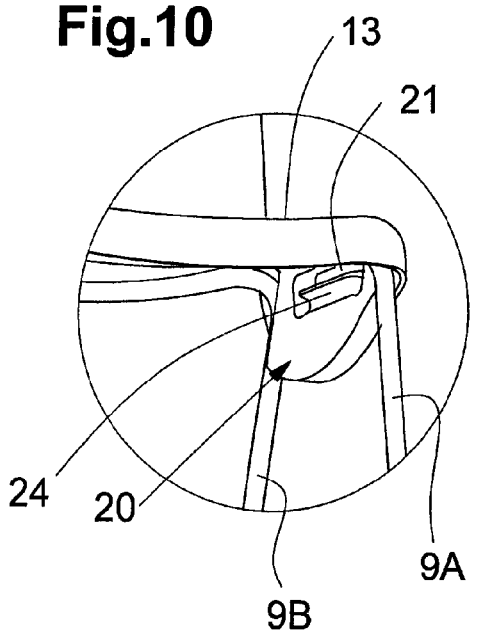
FIG. 10 is an enlarged view of the portion circled in FIG. 9.

As will be seen most clearly from FIGS. 9 and 10, the tubular frame also includes fourth and fifth tubular portions 9A and 9B which are substantially vertical when the seating unit is viewed from the front (FIG. 2). One end of the fourth and fifth tubular portions 9A and 9B respectively is connected to one or other of the first and second tubular portions 3A and 3B respectively. The other ends of the fourth and fifth tubular portions 9A and 9B are connected together by means of a cross bar/a sixth tubular portion 10 having a rectilinear intermediate portion according to the embodiment shown. In the working position of the seating unit, the cross bar 10 is designed to bear against a supporting surface, usually a floor. In the side view of the seating unit according to this invention (see FIGS. 5 and 6), it will be clear that the fourth and fifth tubular portions 9A, 9B diverge away from one another in the direction towards the cross bar 10.

The tubular frame 1 may be manufactured from a suitable metal/alloy or from a suitable plastic material.

The seating unit according to this invention also includes a seat 12 which, according to the embodiment shown, includes a seat portion 13 and a back portion 14, these portions being integral with one another according to the embodiment shown. As will be seen most clearly from FIGS. 2 and 3, the seat portion 13 is supported by the first and second tubular portions 3A, 3B. The abovementioned downward bend/curve of the first and second tubular portions 3A, 3B means that the seat portion 13 can be given a dished shape, this having a positive effect on seating comfort.

Figure 6:
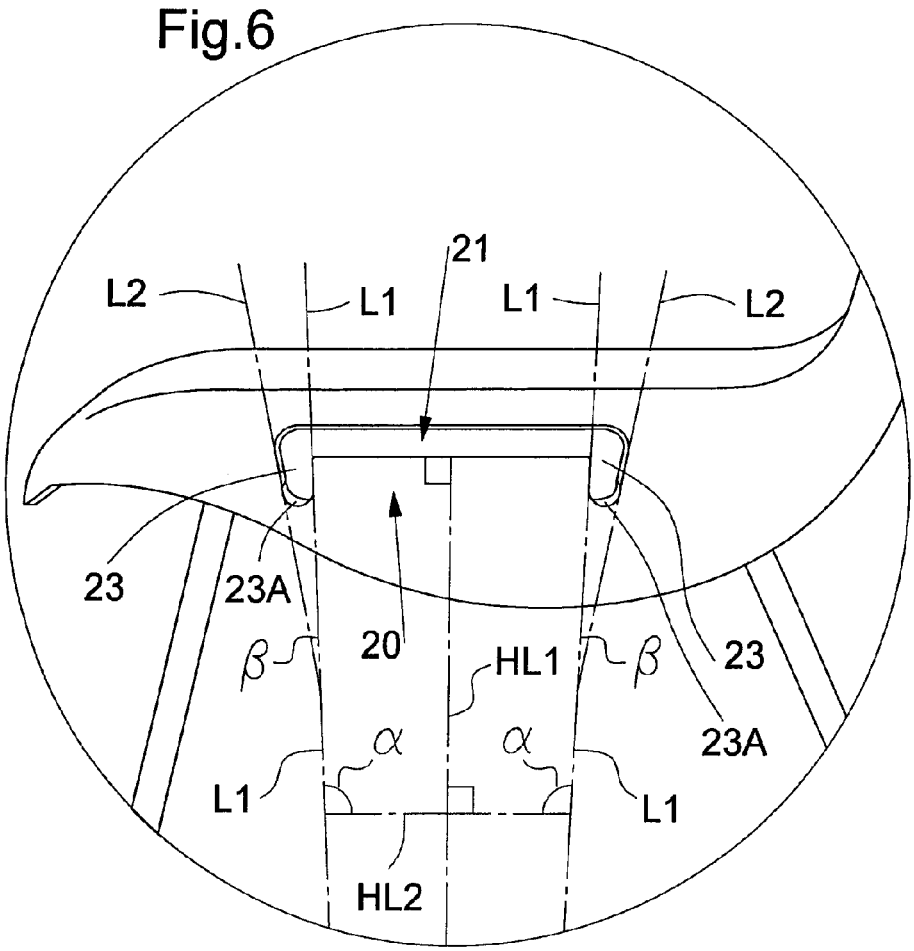
FIG. 6 is an enlarged side view of part of the seating unit according to FIG. 1.

Each seat 12 is provided with a side portion 20 extending downwardly from the seat portion 13, this side portion 20 being situated on the same side of the seat portion 13 as the fourth and fifth tubular portions 9A, 9B. The side portion 20 is provided with an opening 21, this opening 21 being U-shaped when viewed generally, with the bottom 22 of the U having a substantially greater length than the legs 23 of the U. More precisely, the opening 21 is generally speaking dovetailed, i.e. the legs 23 converge slightly towards one another in a direction away from the seat portion 13. This is shown in FIG. 6 by the dash-dotted first lines L1 and by the angles designated $\alpha$ in FIG. 6, symbolising that the lines L1 move closer together in a direction away from the seat portion 13. It should be noted in this connection that the angle $\alpha$ in FIG. 6 corresponds to the angle designated $\alpha$ in FIG. 4. Auxiliary lines HL1 and HL2 have also been drawn in FIG. 6, the first auxiliary line HL1 being situated midway between the first lines L1 and the first auxiliary line HL1 extending at a right angle to the bottom 22 of the U. The second auxiliary line HL2 extends at a right angle to the first auxiliary line HL1. The angle $\alpha$ is the angle between the first lines L1 and the second auxiliary line HL2. The following should apply with respect to the angle $\alpha$: $90° < \alpha \leq 94°$.

FIG. 6 also shows how the walls of the side portion 20 defining the legs 23 converge towards one another in a direction away from the seat portion 13. This is indicated by means of second lines L2 and the angle $\beta$ between the lines L1 and L2. The following should apply with respect to the angle $\beta$: $8° \leq \beta \leq 10°$.

Figure 7:
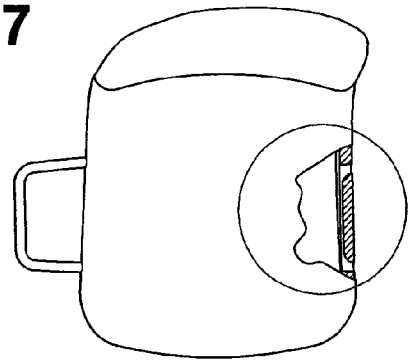
FIG. 7 is a plan view of the seating unit according to FIG. 1 with one part in section.
Figure 8:
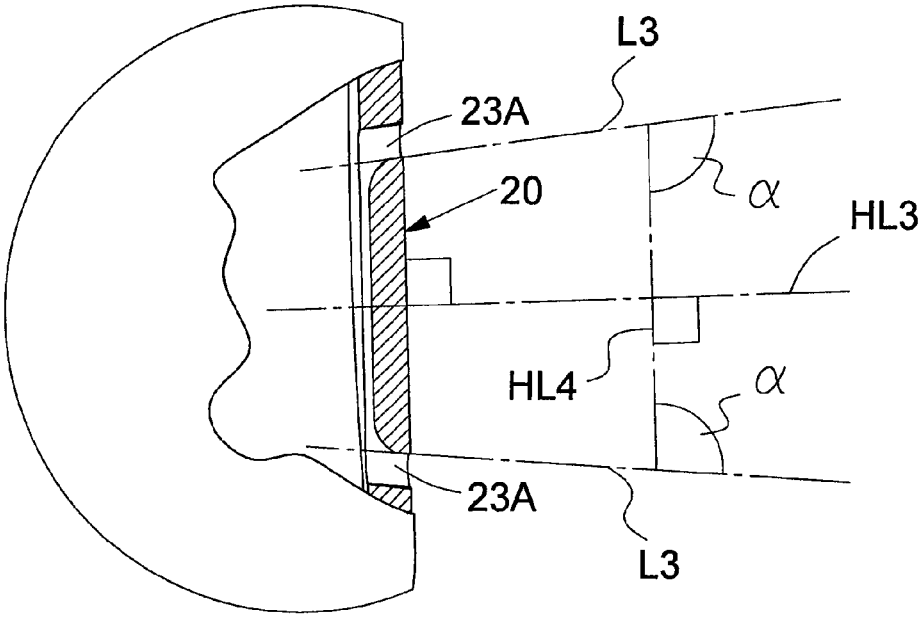
FIG. 8 is a plan view of the sectional part on a larger scale.

With respect to the extension of the legs 23 at a right angle to the plane of the drawing in FIG. 6, the legs 23 thus converge towards one another in a direction under the seat portion 13. This is shown in FIGS. 7 and 8. Two third lines L3, a third auxiliary line HL3 and a fourth auxiliary line HL4 are drawn in FIG. 8. The third lines L3 converge towards one another in a direction under the seat portion 13. The third auxiliary line HL3 is situated midway between the third lines L3 and the third auxiliary line HL3 extends at a right angle to the side portion 20. The fourth auxiliary line HL4 extends at a right angle to the third auxiliary line HL3. The third lines L2, the third auxiliary line HL3 and the fourth auxiliary line HL4 are situated in one common plane. The third lines L3 form an angle $\alpha$ with the fourth auxiliary line HL4, i.e. the same angle $\alpha$ inserted in FIG. 6 and for which a setpoint range was specified hereinabove.

With respect to the free ends 23A of the legs 23 (see FIGS. 6 and 8), these are inclined upwardly from an imaginary horizontal plane in a direction under the seat portion 13. This inclination of the free ends 23A of the legs 23 should preferably correspond to the inclination of the loop 5.

FIGS. 9 and 10 show the opening 21 obliquely from below and from the inside of the side portion 20. It will thus be clear that the wall thickness of the side portion 20 is relatively great and that the side portion 20 is provided on its inside with a retaining means in the form of a recess 24 extending substantially horizontally and between the legs 23. The dimensions of the retaining means/recess 24 are adapted in such a manner that it should be possible for the loop 5 to be received in the retaining means/recess 24 in a satisfactory manner. It should be noted in this connection that the intermediate portion 7 of the loop 5 of a seating unit should be parallel to the retaining means/recess 24. The loop 5 thus fits into the retaining means/recess 24 in a satisfactory manner.

The seat 12 is preferably made of a suitable plastic material.

Figure 11A:
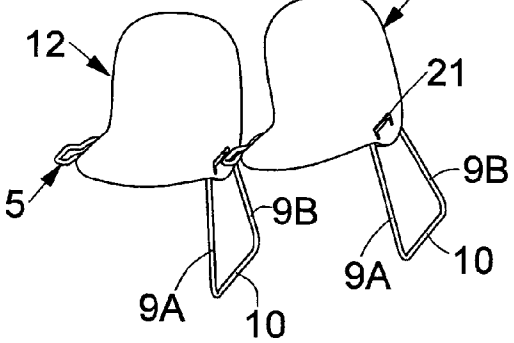
FIG. 11A-FIG. 11C are perspective views showing in diagrammatic form how two seating units are connected together.
Figure 11B:
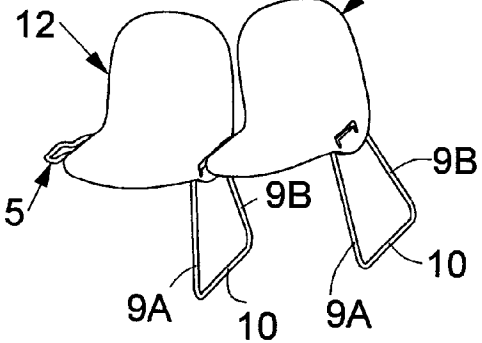
Figure 11C:
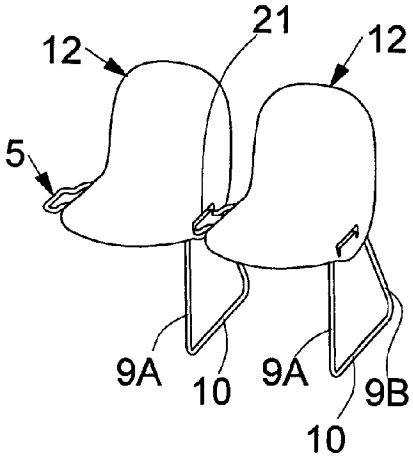

FIGS. 11A-11C show in diagrammatic form how two seating units according to this invention are connected together. In FIG. 11A, two seating units are situated next to one another, although they are separate. In FIG. 11B, the right-hand end of the right-hand seating unit is angled upwards slightly so that the loop 5 serving as a connecting means is substantially horizontal, as a result of which the loop 5 can be inserted into the opening 21 in a simple manner. When the loop 5 has been inserted into the opening 21 to a sufficient extent, the right-hand side of the right-hand seating unit can be angled downwards, resulting in slight separation of the seating units in the plane of the drawing so that the loop 5 should assume the correct final position.

Figure 12:
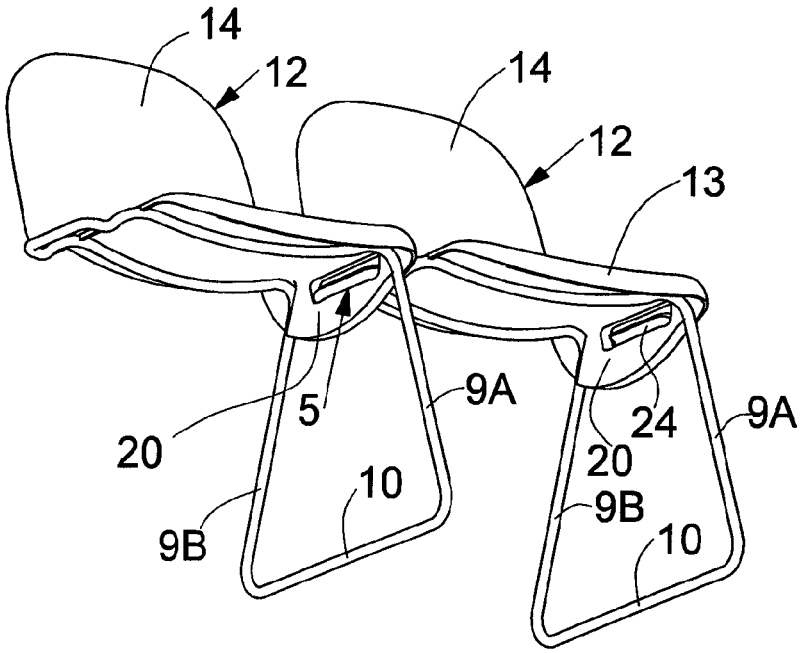
FIG. 12 is a perspective bottom view of two seating units connected together.
Figure 13:
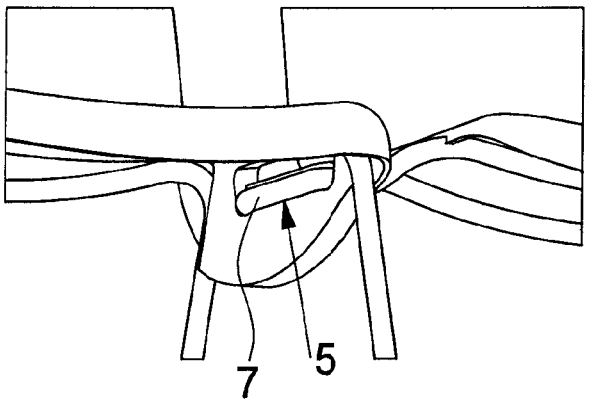
FIG. 13 is an enlarged perspective view of the connection between two seating units.

The correct final position for the loop 5 will be clear from FIGS. 12 and 13. When the loop 5 has assumed the correct final position, the intermediate portion 7 of the loop 5 is then received in the recess 24. As the loop 5 is inclined upwards slightly towards its free end and the free ends of the legs 23 have a corresponding inclination, these matching inclinations lock the right-hand seating unit against undesired displacement towards the left-hand seating unit to a certain extent.

When adjacent seating units are to be disconnected from one another, e.g. when the right-hand seating unit in FIG. 11C is to be disconnected from the left-hand seating unit in FIG. 11C, the right-hand seating unit is displaced towards the left-hand seating unit. The loop 5 is thus displaced out of its position in the recess 24. As a result of the fact that the tubular portions 3A, 3B converge in the direction of the loop 5 at the same time as the legs 23 of the opening 21 converge in the direction away from the seat portion 13, the loop 5 is raised when the seating units are displaced relative to one another. The loop 5 can thus be pulled out through the opening 21, this being facilitated if the right-hand end of the right-hand seating unit is angled upwards slightly. The seating units are thus disconnected from one another.

Figure 15:
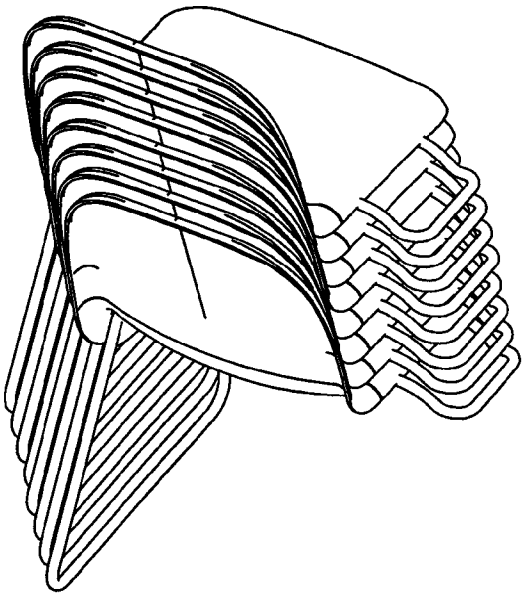
FIG. 15 is a different perspective view of the stacked seating units.
Figure 14:
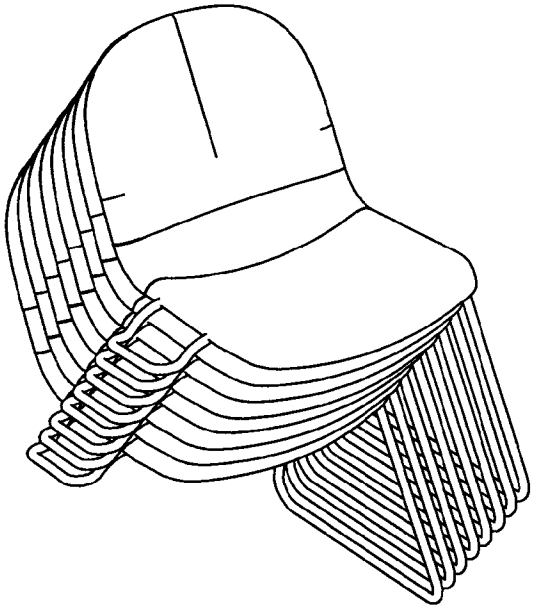
FIG. 14 is a perspective view of a number of seating units according to FIG. 1 stacked one on top of the other.
Figure 16:
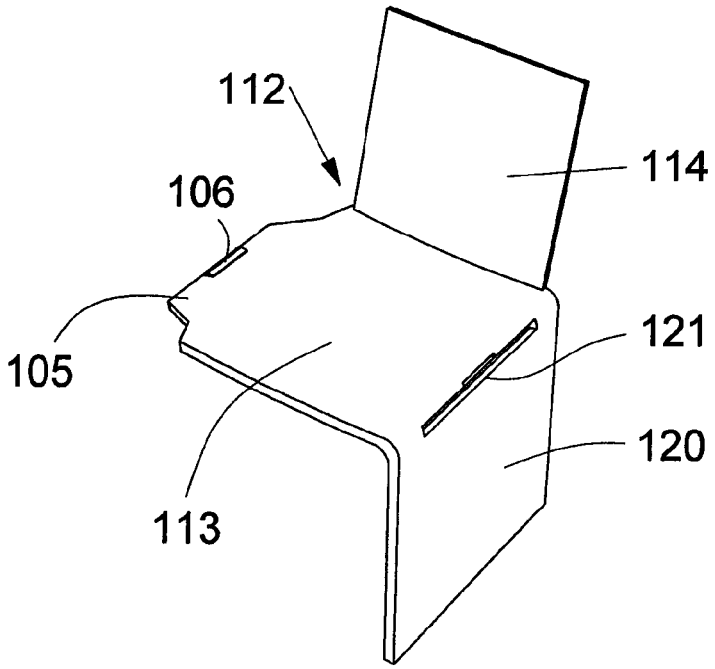
FIG. 16 is a perspective view of another embodiment of a seating unit according to this invention.
Figure 17:
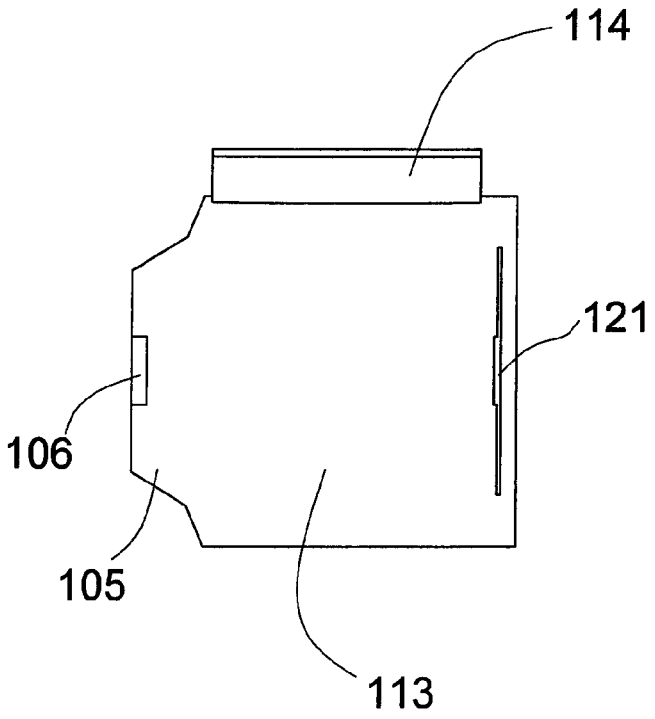
FIG. 17 is a plan view of the seating unit according to FIG. 16.
Figures 18, 19, 20:
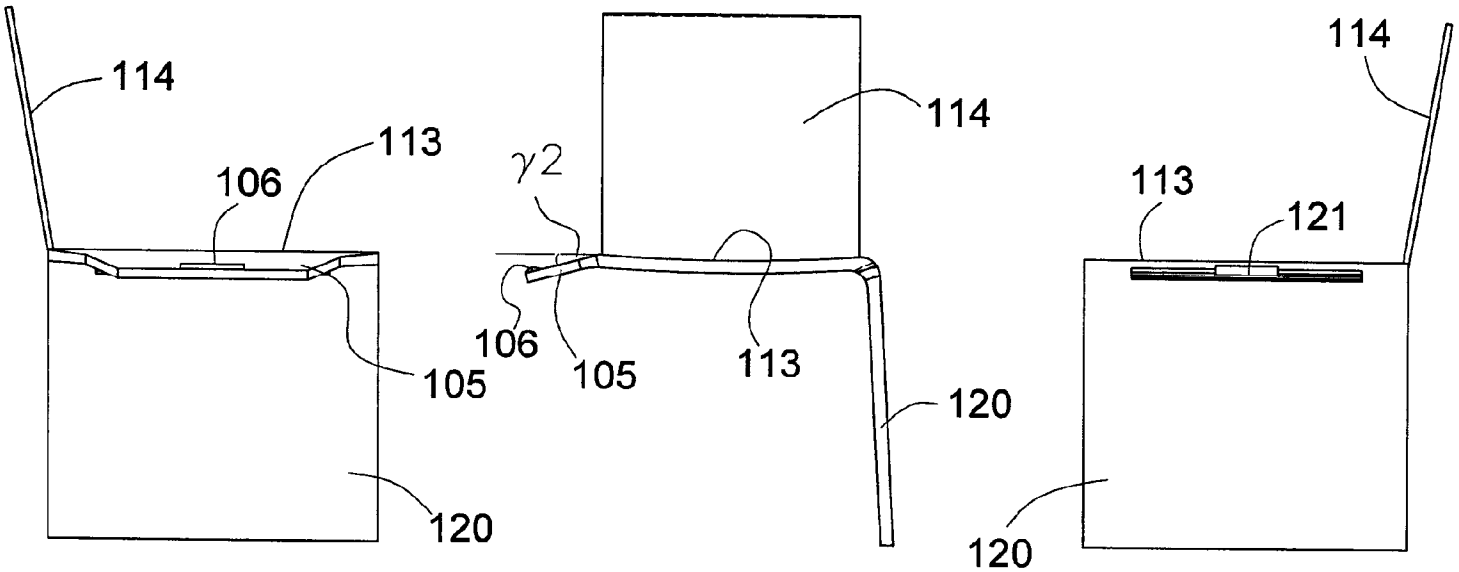
FIG. 18 is a side view of the seating unit according to FIG. 16.
FIG. 19 is a front view of the seating unit according to FIG. 16.
FIG. 20 is a side view of the seating unit according to FIG. 16.

FIGS. 14 and 15 show how a number of seating units according to this invention can be stacked one inside the other. This offers a clear advantage with respect to the storage of the seating units when they are not in use.

FIGS. 16-20 show an alternative embodiment of a seating unit according to this invention, in which a characterising feature of the seating unit according to FIGS. 16-20 is that the parts forming part of the seating unit are integral with one another, i.e. the seating unit according to FIGS. 16-20 is formed in one piece. The seating unit according to FIGS. 16-20 is preferably made of a suitable plastic material, wherein one conceivable method of manufacturing the seating unit according to FIGS. 16-20 may be injection moulding.

The seating unit according to FIGS. 16-20 includes a seat 112 which, according to the embodiment shown, includes a seat portion 113 and a back portion 114, these portions being integral with one another according to the embodiment shown. The seat portion 113 is given a dished shape, this having a positive effect on seating comfort.

A connecting means in the form of a tongue 105 departs from one side of the seat portion 113 and is integral with the seat portion 113. As will be seen most clearly from FIGS. 16-18, the tongue has a generally tapering shape towards its free end. As will be seen most clearly from FIGS. 18 and 19, the tongue 105 extends obliquely downwards from the seat portion 113 towards the free end of the tongue 105. The inclination of the tongue relative to a plane parallel to the surface on which the seating unit rests in the effective position is designated $\gamma 2$ in FIG. 19. $\gamma 2$ is preferably within the range: $13° \leq \gamma 2 \leq 15°$.

A shoulder 106 is provided on the top of the tongue 105 in the region of its free end, the shoulder 106 being situated in the centre of the free end of the tongue 105. The shoulder 106 is preferably integral with the tongue 105.

Each seating unit is provided with a side portion 20 extending downwardly from the seat portion 113, this side portion 120 being situated on one side of the seat portion 113. The side portion 120 extends from the seat portion 113 down to the surface on which the seating unit is supposed to be supported when the seating unit is in the effectively connected position. The side portion 120 is integral with the seat portion 113. The side portion extends substantially vertically in the effectively connected position of a seating unit.

The side portion 120 is provided with an opening 121, this opening having an oblong rectangular shape when viewed generally. The dimensions of the tongue 105 and of the opening 121 are adapted to one another in such a manner that the tongue 105 of one seating unit can be inserted into the opening 121 in the seating unit to which it is to be connected. The opening 121 is to this end provided with a recess allowing for the passage of the shoulder 106 when the tongue 105 is inserted into the opening 121.

Figure 21:
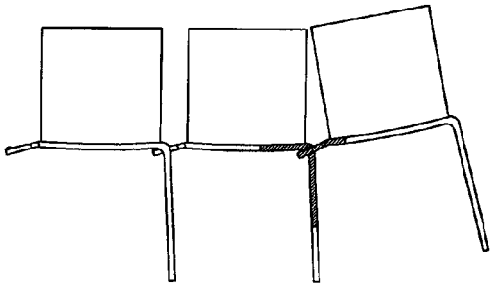
FIG. 21 is a front view of three seating units according to FIG. 16 connected together, with one seating unit in the process of being mounted.
Figure 22:
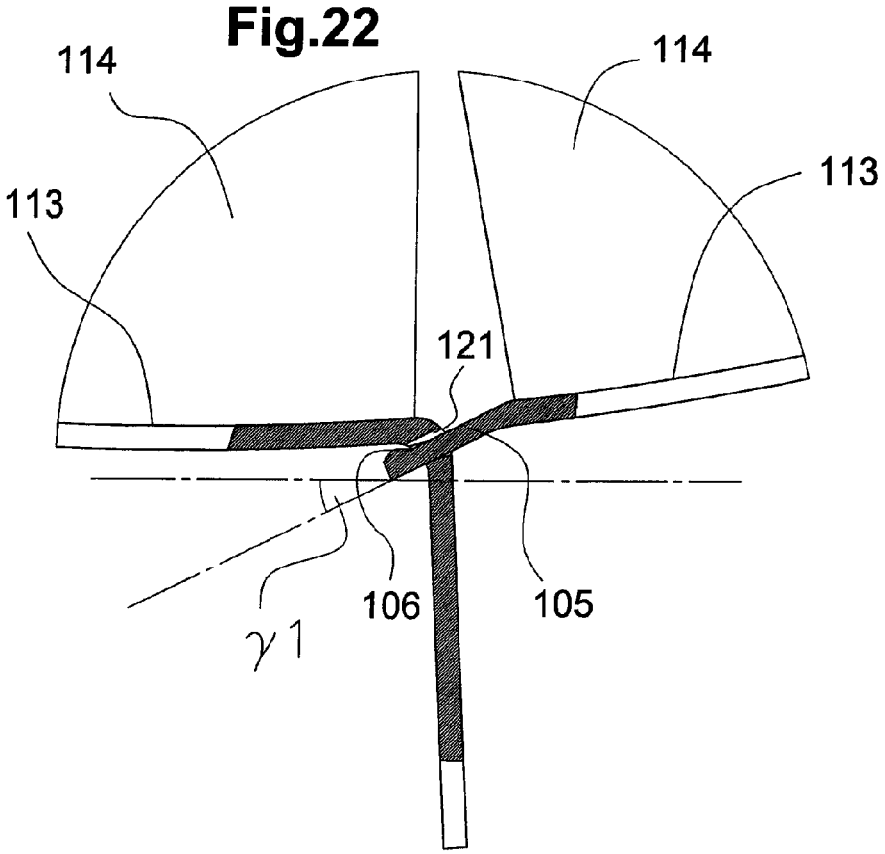
FIG. 22 is an enlarged view of the sectional part of FIG. 21.
Figure 23:
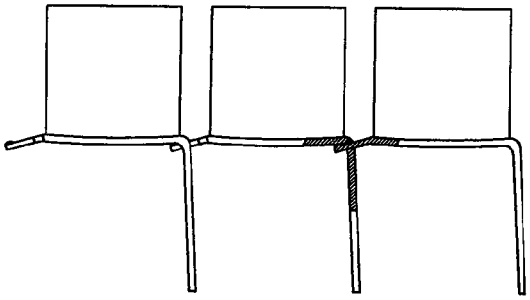
FIG. 23 is a front view of three seating units according to FIG. 16 finally connected together.

FIGS. 21-24 show in diagrammatic form how two seating units according to FIGS. 16-20 are connected together. In FIG. 21, two seating units are connected together, while a third seating unit is in the process of being connected. As will be seen more clearly from FIG. 22, the tongue 105 has been inserted into the opening 121, wherein the seating unit to be mounted is thus inclined slightly, i.e. the end situated furthest away from the already mounted seating units is raised slightly. FIG. 22 shows in detail how the tongue 105 is oriented in the opening 121 during the mounting phase itself. The principal plane defined by the tongue 105 therefore forms an angle $\gamma 1$ with a plane parallel to the plane on which the seating units rest. When the tongue 105 has been inserted as far as it goes into the opening 121, the raised end of the seating unit is lowered so that it rests on the supporting surface. The tongue 105 thus assumes the position shown in FIG. 24, i.e. the shoulder 106 is angled upwardly and is in contact with the underside of the seat portion 113 of the seating unit to which it is to be connected. The shoulder 106 is preferably covered in a friction material. A recess for receiving the shoulder 106 may be provided on the underside of the seat portion 113.

Figure 24:
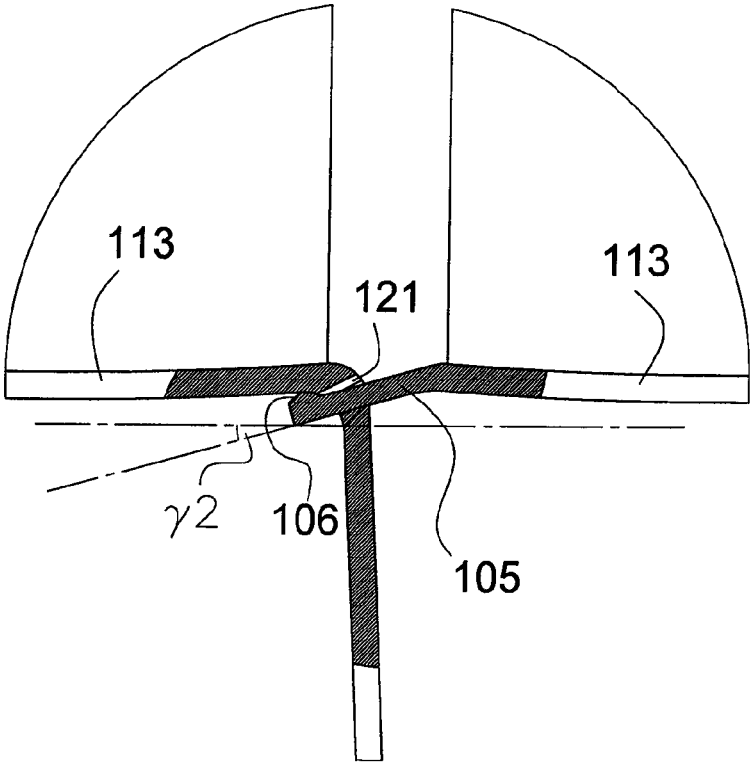
FIG. 24 is an enlarged view of the sectional part of FIG. 23.

Looking at FIG. 24, it will be clear that the shoulder 106 locks the two seating units connected together in such a manner that they cannot be separated in the lateral direction. The angle $\gamma 2$ between the principal plane of the tongue 105 and the plane parallel to the plane on which the seating units rest is thus reduced, i.e. $\gamma 1 > \gamma 2$. It should be noted in this connection that the angle $\gamma 2$ is the same in FIG. 19 and FIG. 24.

In order to separate the seating units according to FIGS. 16-20 from one another, the procedure described in connection with FIGS. 21-24 is followed, i.e. the seating unit to be disassembled is angled upwardly and the tongue 105 is pulled out through the opening 121 in the adjacent seating unit.

Figure 25:
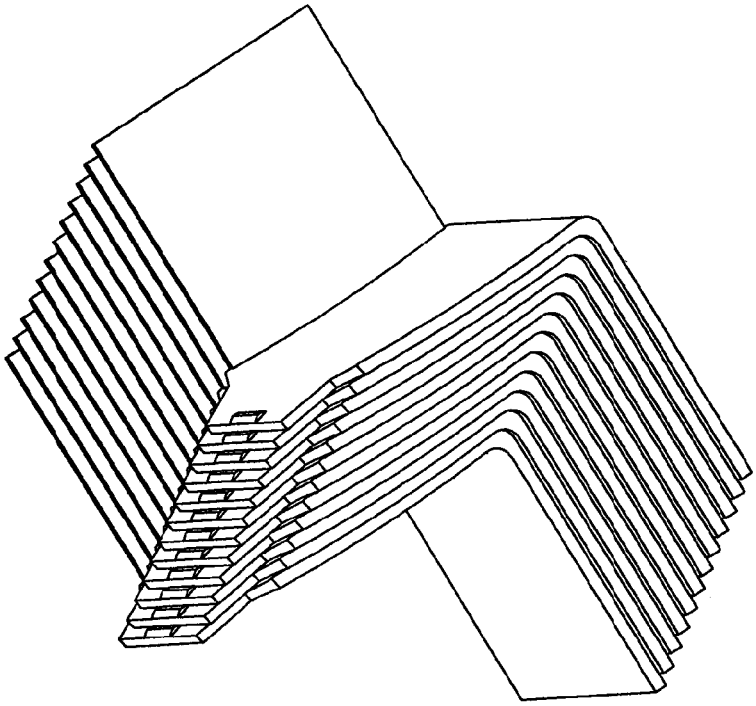
FIG. 25 is a perspective view of a number of seating units according to FIG. 16 stacked one on top of the other.

FIG. 25 shows a number of seating units stacked one on top of the other. As each seating unit only "builds" upon the height by the thickness of the corresponding seat portion 113, an extremely compact unit is obtained upon stacking.

It should also be noted that the seating unit situated at one end of the row of seating units connected together must be provided with a special support for its connecting means 5; 105 or it may be conceivable to use a specially designed seating unit which is more like a conventional chair, i.e. which can stand independently on the floor.

Possible Modifications of the Invention

In the embodiment according to FIGS. 1-15 described hereinabove, it is not necessary to have an upwardly angled loop 5 with corresponding inclination of the free ends of the legs 23. According to this invention, it may be conceivable for the loop 5 to be horizontal in the effective position and for the free ends of the legs likewise to be horizontal in the effective position.

In the embodiment according to FIGS. 16-20 described hereinabove, the shape of the tongue 105 may be varied, particularly with respect to the extent to which the tongue tapers towards its free end. A certain tapering is preferred as it facilitates the insertion of the tongue into the opening in the adjacent seating unit.

Instead of a solid tongue 105, it may also be conceivable according to the invention for the connecting means to be in the form of a loop, but with the same basic shape as the tongue. This therefore results in a weight saving. The outermost part of the loop can therefore be covered in a friction material, resulting in an increase in the diameter of the outermost part of the loop and thereby offering the equivalent of a shoulder.

In the embodiments described hereinabove, the seat 12; 112 is provided with a back. According to this invention, it is conceivable for the seat not to have a back or for the back to be formed by a separate part that can be mounted on the seat.

If the seat is made of a material, e.g. some sort of metal, that may be perceived as cold and hard by certain users, it may be conceivable for the seat to be provided with a shell, e.g. of pressed felt.

The invention claimed is:

1. A seating unit, consisting essential of:

a seat (12; 112);

a connecting part (5; 105);

a support part (9A, 9B, 10; 120); and an opening (21, 121), wherein, the seat has a first side, an opposite second side, and a generally horizontal seating surface extending between the first side and the second side, the connecting part is located at the first side of the seat;

the support part is located at the second side of the seat and extends downward to a floor surface, the support part supports the second side of the seat relative to the floor surface when the seating unit is connected to another seating unit of the same kind having a corresponding seat, a corresponding connecting part on a corresponding first side of the corresponding seat, and a corresponding support part on a corresponding second side of the seat, the corresponding support part of the other seating unit is required to support the first side of the seat of the seating unit relative to the floor surface as the first side of the seat of the seating unit is free of any support part located at the first side of the seat and extending downward to the floor surface, and the opening of the seating unit is located at the second side of the seat of the seating unit and is sized to receive the corresponding connecting part of the other seating unit and thereby have the corresponding support part of the other seating unit support the first side of the seat and the seating unit on the floor surface, with the seating unit and the other seating unit detachably locked against mutual separation.

2. The seating unit according to claim 1, wherein the connecting part (5; 105) includes a free end (7) and tapers towards the free end (7).

3. The seating unit according to claim 1, wherein the support part comprises a tubular frame.

4. The seating unit according to claim 1, wherein the opening (21) is generally U-shaped.

5. The seating unit according to claim 1, wherein the connecting part is in the form of a tongue (105) and that a shoulder (106) is arranged on the top of the tongue (105).

6. The seating unit according to claim 1, wherein the support part comprises a tubular frame supporting the seat (12), and the tubular frame together with the connecting part defines a loop projecting beyond the first side of the seat (12).

7. A seating arrangement, comprising a first and a second of said seating unit of claim 1 detachably connected together with the connecting part (5; 105) of the first seating unit received in the opening (21; 121) of the second seating unit, the support part (9A, 9B, 10; 120) of the second seating unit supporting the first side of the seat of the first seating unit on the floor surface.

* * * * *